US006777651B1

(12) United States Patent
Boyer

(10) Patent No.: US 6,777,651 B1
(45) Date of Patent: Aug. 17, 2004

(54) COOK TIME CONTROL SYSTEM FOR CONVECTION COOKING APPLIANCE

(75) Inventor: Mark A. Boyer, Harrison, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/410,289

(22) Filed: Apr. 10, 2003

(51) Int. Cl.[7] ..... A21B 1/26; A21B 1/40; H05B 1/02

(52) U.S. Cl. ..... 219/400; 219/411; 219/412; 219/506; 219/509; 219/492

(58) Field of Search ..... 219/400, 411–413, 219/492, 494, 506, 508, 510, 681

(56) References Cited

U.S. PATENT DOCUMENTS 4,761,539 A * 8/1988 Carmean ..... 219/494
5,352,874 A * 10/1994 Gong ..... 219/506
5,382,441 A * 1/1995 Lentz et al. ..... 426/241
5,756,970 A 5/1998 Barger et al.
5,767,488 A 6/1998 Barger et al.
5,808,278 A 9/1998 Moon et al.
5,990,454 A * 11/1999 Westerberg et al. ..... 219/411
6,005,229 A 12/1999 Brown et al.
6,252,206 B1 6/2001 Leukhardt, III et al.
6,486,453 B1 11/2002 Bales et al.

* cited by examiner

*Primary Examiner*—Joseph Pelham
(74) *Attorney, Agent, or Firm*—Diederiks & Whitelaw, PLC

(57) ABSTRACT

A cooking appliance employing rapid cook technology includes a controller which calculates rapid cook times from conventional cooking times input by a user. That is, for relatively long convection cooking cycles, such as a convection roasting mode, after a user enters a standard radiant cooking time into a control panel, an electronic controller subtracts a certain percentage, preferably 25%, off of the standard time to establish a rapid cook time. In one preferred embodiment, the rapid cook time is presented in a display and used as the actual cook time for the cooking operation. In another preferred embodiment, the standard cooking time is established for the cooking operation, but the user is signaled to check the food when the rapid cook time expires.

20 Claims, 2 Drawing Sheets

50
54
181
180
176
175
182
148
142
62
141
140
145
161
153
163
155
151
165
160
152
162
154
164
104
106
102
108
112
100
110
90
80
92
82
88
84
86
53
52
TIMER2 On/Off
TIMER1 On/Off
Help
Favorites
Setup
Back
Enter
UPPER OVEN
Bake
Broil
Convect
Clean
CANCEL
More Options
Oven Light
LOWER OVEN
BAKE ELEMENT
BROIL ELEMENT
FAN
CONVECT HEATING ELEMENT
CPU
TIME CONVERSION CIRCUIT
TEMP SENSORS
FAN SPEED SENSOR
40
42
44
46
200
225
210
215

COOK TIME CONTROL SYSTEM FOR CONVECTION COOKING APPLIANCE

BACKGROUND OF THE INVENTION

1. Field of the Invention

The present invention pertains to the art of cooking appliances and, more particularly, to a system for determining a cooking time for a convection oven based on a user inputted time for a conventional cooking process.

2. Discussion of the Prior Art

The art of cooking is currently undergoing substantial change. It is no longer the norm to have a family member home all day with time to cook and prepare meals. Today, more and more consumers must rush home from work to prepare meals for themselves or for their families. In today's fast paced society, time is of the essence. The luxury of spending time in preparing a meal is becoming less and less affordable. As such, consumers demand an oven that will cook a meal in less time than conventional ovens, without sacrificing the quality of the prepared food. In order to meet these demands, manufacturers are combining conventional radiant cooking systems with the rapid cook advantages of convection, microwave, and other types of cooking systems.

However, the problem with designing an oven capable of rapidly and effectively cooking a food item is exacerbated by the wide array of consumer tastes. No single cooking process lends itself to efficiently cook the wide variety of food items desired by consumers. For example, while conventional radiant cooking is suitable to a wide assortment of food types, the overall cooking process, especially baking, can be quite slow. The pre-heat time, combined with the cook time, is longer than most businesses or consumers desire.

Microwave ovens, on the other hand, are capable of performing a rapid cooking operation. Unfortunately, the types of food items and cooking processes found to be suitable for microwave cooking are limited. For instance, microwaves, by themselves, are often not suitable for baking or for preparing food items which require a crunchy texture. Yet another method of rapidly cooking a food item is through forced air convection. Forced air convection allows for cooking at lower temperatures as compared to conventional radiant cooking processes. The forced air streams serve to disrupt a thermal insulation layer about the food item which increases the heat transfer rate between the food item and its surroundings.

It is considered that a design incorporating a forced air convection system capable of performing both convection and standard radiant bake cooking can enable an appetizing meal to be prepared in a short time period. The prior art has many examples of ovens which combine several types of cooking processes. However, most are limited in the types of cooking processes performed. In addition, since the use of the convection cooking reduces the overall cook time, consideration has to given to establishing a suitable cooking period. That is, regardless of the fact that rapid cook systems are becoming more well known, available recipes generally only provide cook time information based on conventional radiant cooking. This fact places a burden on the user to either calculate a time for convection cooking based on the conventional cook time provided or periodically check the food to prevent over-cooking. Either situation is considered less than ideal.

To address this concern, it has been proposed in the art of rapid cooking systems to employ an automatic time conversion arrangement. In such an arrangement, a controller of a rapid cooking appliance would automatically deduct a certain percentage or time value from a user set period of time. That is, the controller would assume that the user is inputting a time based on a conventional cooking operation and automatically deducts a percentage of the time to establish a rapid cook time period. Most often, the percentage utilized is fixed and consistently applied. However, the percentage can vary based on selected food groups. Regardless, the time reduction is universally performed whenever a rapid cook operation is selected.

Although this arrangement works well in connection with cooking various foods, the system is not considered to work well when universally applied in the manner set forth in accordance with the known prior art. Accordingly, based on at least these reasons, there still exists a need in the art for a rapid cooking appliance adapted to more effectively address differences between an inputted conventional cook time period and a rapid cook time period, at least under appropriate circumstances, to effectively perform a variety of cooking processes for a wide range of foods.

SUMMARY OF THE INVENTION

The present invention is directed to a cooking appliance including both conventional radiant cooking techniques and rapid cook technology, preferably a cooking appliance employing both radiant and convection cooking systems. The preferred form of the invention concerns a combination radiant and convection cooking appliance incorporating a controller which allows a user to enter standard cooking times for convection cooking without the need to calculate convection cook times. Thereafter, the cooking appliance of the invention calculates a reduced convection time from the standard cooking time entered and utilizes this reduced convection time in connection with the overall cooking operation as set forth below.

In accordance with the one preferred form of the invention, after a user enters a standard radiant cooking time into a control panel, an electronic controller subtracts 25% off of the standard time. This reduced time is then shown in a display provided in the control panel. The controller will use this time as the actual cook time for the cycle. However, in order to assure food quality, this method is only employed in relatively long convection cooking cycles, such as a convection roasting mode. In accordance with a second preferred embodiment of the invention, the reduced cook time is calculated, but the controller allows the cooking appliance to perform the cooking operation based on the standard cooking time entered by the user. However, after 75% of that time has elapsed, the user is signaled, such as through a message on the display and an audible beep or the like. Therefore, the user is prompted to check the food when a majority of the standard cooking time has elapsed to prevent potential over-cooking.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE PREFERRED EMBODIMENT

Figure 1:
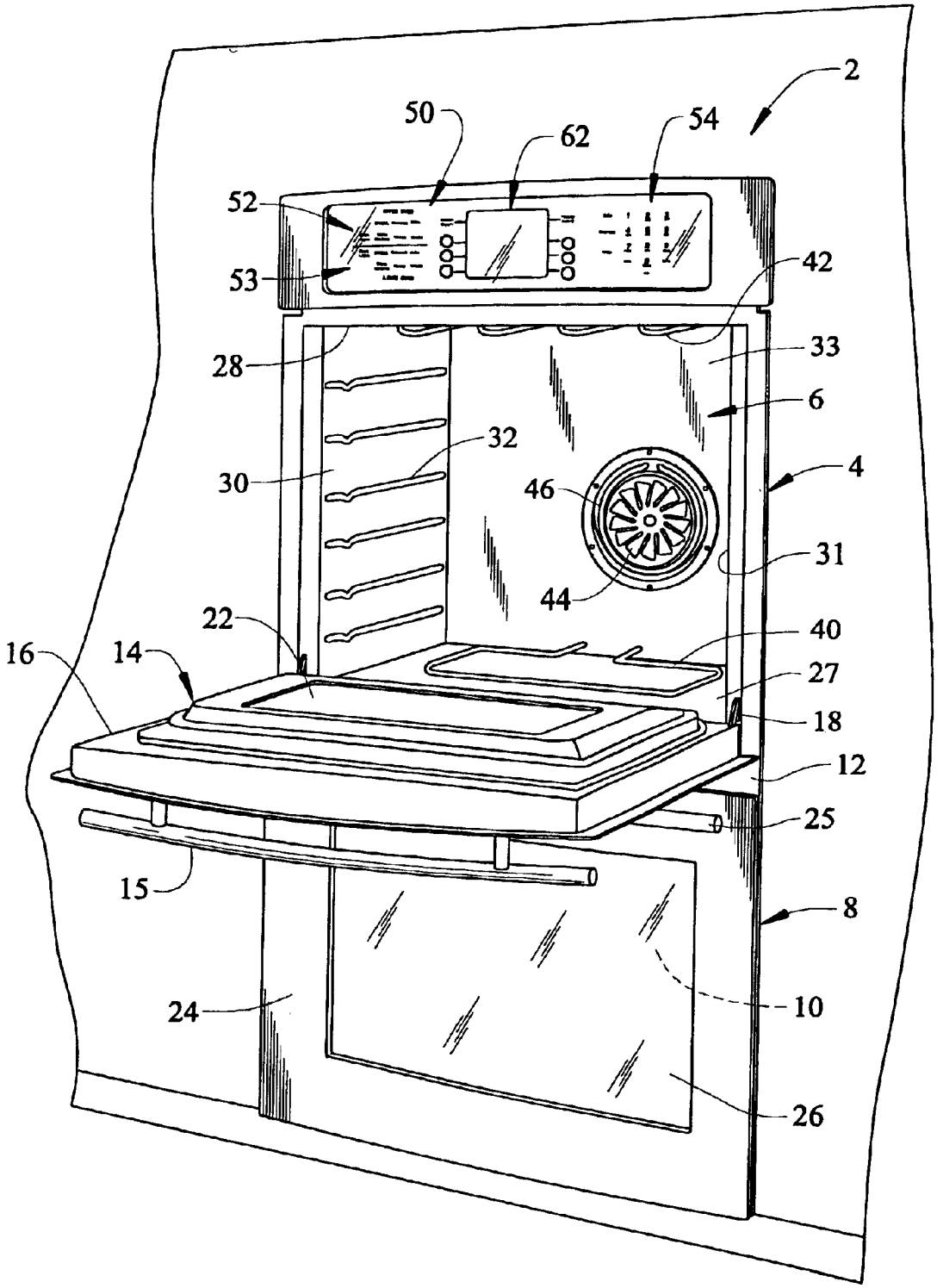
FIG. 1 is a perspective view of a wall oven constructed in accordance with the present invention.

With initial reference to FIG. 1, a cooking appliance constructed in accordance with the present invention is generally indicated at 2. Cooking appliance 2, as depicted, constitutes a double wall oven. However, it should be understood that the present invention is not limited to this model type and can be incorporated into various types of oven configurations, e.g., cabinet mounted ovens, as well as both slide-in and free standing ranges. In any event, in the embodiment shown, cooking appliance 2 constitutes a dual oven wall unit including an upper oven 4 having upper oven cavity 6 and a lower oven 8 having a lower oven cavity 10. Cooking appliance 2 includes an outer frame 12 for supporting both upper and lower oven cavities 6 and 10.

In a manner known in the art, a door assembly 14 is provided to selectively provide access to upper oven cavity 6. As shown, door assembly 14 includes a handle 15 at an upper portion 16 thereof. Door assembly 14 is adapted to pivot at a lower portion 18 to enable selective access to within oven cavity 6. In a manner also known in the art, door 14 is provided with a transparent zone or window 22 for viewing the contents of oven cavity 6 while door 14 is closed. A corresponding door assembly 24 including a handle 25 and a transparent zone or window 26 is provided to selectively access lower oven cavity 10.

As best seen in FIG. 1, oven cavity 6 is defined by a bottom wall 27, an upper wall 28, opposing side walls 30 and 31 provided with a plurality of vertically spaced side rails 32, and a rear wall 33. In the preferred embodiment shown, bottom wall 27 is constituted by a flat, smooth surface designed to improve the cleanability of oven cavity 6. Arranged about bottom wall 27 of oven cavity 6 is a bake element 40. Also, a top broiler element 42 is arranged along upper wall 28 of oven cavity 6. Top broiler element 42 is provided to enable a consumer to perform a grilling process in upper oven 4 and to aid in pyrolytic heating during a self-clean operation. In the preferred form of the invention shown, both bake element 40 and top broiler element 42 are constituted by sheathed electric resistive heating elements.

Based on the above, in the preferred embodiment depicted, cooking appliance 2 actually constitutes an electric, dual wall oven. However, it is to be understood that cooking appliance 2 could equally operate on gas, either natural or propane. In any case, both oven cavities 6 and 10 preferably employ both radiant and convection heating techniques for cooking food items therein. To this end, rear wall 33 is shown to include a convection fan or blower 44. Although the exact position and construction of fan 44 can readily vary in accordance with the invention, in accordance with the most preferred form of the invention, fan 44 draws in air at a central intake zone (not separately labeled) and directs the air into oven cavity 6 in a radial outward direction. Also as clearly shown in this figure, another sheathed electric heating element 46, which preferably takes the general form of a ring, extends circumferentially about fan 44 in order to heat the radially expelled air flow. At this point, it should be noted that a fan cover, which has not been shown for the sake of clarity of the drawings, extends about fan 44 and heating element 46, preferably with the cover having an associated central inlet opening and a plurality of outer radial outlets openings.

Figure 2:
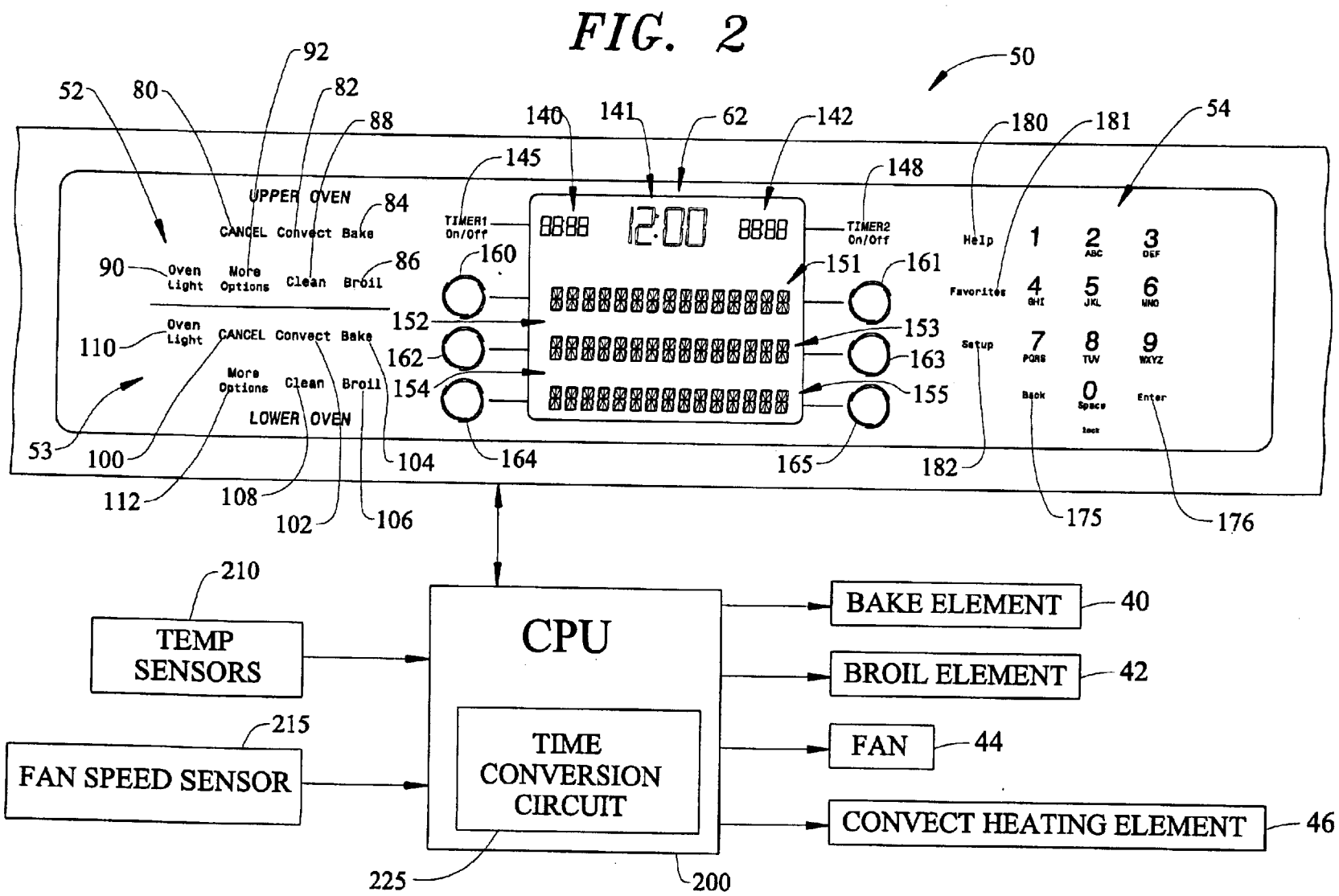
FIG. 2 is an enlarged view of a control panel and system employed in connection with the wall oven of FIG. 1.

As further shown in FIGS. 1 and 2, cooking appliance 2 includes an upper control panel 50 having a plurality of control elements. In accordance with one embodiment, the control elements are constituted by first and second sets of oven control buttons 52 and 53, as well as a numeric pad 54. Control panel 50 is adapted to be used to input desired cooking parameters for cooking appliance 2. More specifically, the first and second sets of control buttons 52 and 53, in combination with numeric pad 54 and a display 62, enable a user to establish particular cooking operations for upper and lower ovens 4 and 8 respectively.

In the preferred embodiment particularly shown in FIG. 2, first set of control buttons 52 includes a cancel button 80, a convection button 82, a bake button 84, a broil button 86, and a clean button 88. In addition, first set of control buttons 52 also preferably includes an oven light button 90 and a button 92 used to access more cooking options which are conveyed to the user through display 62. In a corresponding manner, second set of control buttons 52 includes a cancel button 100, a convection button 102, a bake button 104, a broil button 106, and a clean button 108. Furthermore, second set of control buttons 53 also preferably includes an oven light button 110 and a button 112 which is used to access more cooking options that are conveyed to the user through display 62.

To this end, display 62 is preferably divided into various sections. In accordance with the most preferred embodiment of the invention, an uppermost section of display 62 is sub-divided into three time display zones 140–142. More specifically, leftmost display zone 140 constitutes a first timer zone having an associated timer button 145. Central display zone 141 constitutes a clock for cooking appliance 2. Rightmost display zone 142 constitutes a second timer zone having an associated timer button 148.

Spaced below time display zones 140–142 are a series of vertically spaced information display zones 151–155. Each of information display zones 151, 153 and 155 has associated left and right portions (not separately labeled). As will be detailed more fully hereinafter, each of the left and right portions have associated therewith laterally positioned selection buttons 160–165.

As shown, numeric pad 54 preferably enables alphanumeric input. That is, in addition to presenting numbers 0–9, numeric pad 54 doubles as an input source for alpha information. To this end, the number 2button functions for ABC letter entry; the number 3button functions for DEF letter entry; the number 4button functions for GHI letter entry; the number 5button functions for JKL letter entry; the number 6button functions for MNO letter entry; the number 7button functions for PQRS letter entry; the number 8button functions for TUV letter entry; and the number 9button functions for WXYZ letter entry. The number 0button can also be used to input a space. On either side of the number 0button are Back and Enter buttons 175 and 176 which can be used in combination with the various alpha keys for information entry. Finally, provided adjacent numeric pad 54 are Help, Favorites and Setup buttons 180–182.

In general, control panel 50 is linked to a controller or CPU 200 formed as part of cooking appliance 2. Therefore, CPU 200 receives user inputs and selections through control panel 50, as well as signals from sensors associated with cooking appliance 2, i.e. oven temperature sensors for upper and lower ovens 4 and 8 as generally indicated at 210 and a blower speed sensor 215. In turn, CPU 200 controls bake element 40, top broiler element 42, convection fan 44 and convection heating element 46.

Since general programming aspects employed by a user of cooking appliance 2 does not form part of the present invention, these features will not be discussed further here. Instead, the present invention is particularly directed to the incorporation and operation of a time conversion circuit 225 in connection with CPU 200. More specifically, in accordance with the invention, time conversion circuit 225 functions to take a standard cooking time entered by a user through control panel 50 and automatically calculates a reduced convection time from the standard is cooking time entered.

In accordance with the invention, after a user selects a desired convection cooking operation through either of the first and second rows of control buttons 52, 53, the user is prompted to enter a standard radiant cooking time through numeric pad 54. If the cook time is greater than a predetermined amount, preferably equal to or greater than one hour, time conversion circuit 225 automatically subtracts a certain percentage off of the standard time to arrive at a convection cook time. Therefore, time conversion circuit 225 determines if the inputted cook time is greater than a predetermined amount and, if so, the automatic reduced time calculation is performed.

Although the exact amount subtracted from the inputted, standard time can vary, in accordance with the most preferred form of the invention, time conversion circuit 225 subtracts 25% to establish the convection cook time. However, in order to assure food quality, this method is only employed in relatively long convection cooking cycles. That is, for short convection cooking times, generally in the order of less than 1 hour, time conversion circuit 225 will not even perform the convection cook time calculation as the convection cooking has less of an effect on the overall cooking process. However, during longer cook periods, such as a convection roasting mode of operation, the convection cook time calculation is established, preferably at the 75% amount.

In accordance with one preferred embodiment of the invention, CPU 200 utilizes the calculated convection cook time as the actual cook time for the cooking operation. Therefore, following entry of the standard cook time and the calculation of the convection cook time, the reduced time is then shown in display 62, such as in timer zone 140. Therefore, a user is able to enter a standard radiant cooking time, such as that set forth in a conventional recipe and, so long as the cooking time is greater than the predetermined minimum time limit established for time conversion circuit 225, the standard radiant cooking time will be automatically reduced and the selected cooking operation will be performed based on the established convection cook time. This reduction in cooking time, in combination with the addition of the convection heating, has been found to maintain the quality of the food being cooked while significantly reducing the required preparation time.

In accordance with a second preferred embodiment of the invention, the convection cook time is still calculated in the manner set forth above. However, instead of automatically reducing the standard cooking time entered by the user, CPU 200 allows cooking appliance 2 to perform the cooking operation based on the standard cooking time but, after 75% of that time has elapsed, the user is signaled to check the cooking progress of the food. In accordance with this embodiment, the user is preferably signaled through a message, such as "Check Food", provided in display 62, as well as an audible beep or the like presented as a reminder. Therefore, in accordance with this aspect of the invention, the calculated convection cook time is used to prompt the user to check the food when a majority of the standard cooking time has elapsed in order to prevent potential over-cooking. In the most preferred form of this embodiment, the user is prompted when 75% of the standard cooking operation is completed, with this signaling arrangement being only performed during longer cook periods in a manner corresponding to that set forth above.

Although described with reference to preferred embodiments of the invention, it should be readily understood that various changes and/or modifications can be made to the invention without departing from the spirit thereof. For instance, the rapid cook time could be calculated for each cooking operation, but only used by the controller in the manner set forth above when the set cooking time is greater than the predetermined amount. In general, the invention is only intended to be limited by the scope of the following claims.

I claim:

1. A cooking appliance comprising:

an oven cavity;

at least one radiant heating element arranged for producing radiant heat in the oven cavity;

a rapid cook heating source;

a control panel for both selecting a desired cooking operation for the oven cavity and inputting a cooking time for the desired cooking operation;

time conversion means for automatically calculating a rapid cook time which is equal to a reduced percentage of the cooking time, only if the cooking time is greater than a predetermined amount; and means for controlling the at least one radiant heating element and the rapid cook heat source to perform the desired cooking operation.

2. The cooking appliance according to claim 1, wherein the rapid cook heating source comprises:

a fan for developing a convection air flow within the oven cavity; and a convection heating element for heating the air flow.

3. The cooking appliance according to claim 2, wherein said calculating means reduces the cooking time by 25% to set the rapid cook time.

4. The cooking appliance according to claim 3, wherein the predetermined amount is equal to or greater than one hour.

5. The cooking appliance according to claim 1, wherein said controlling means performs the desired cooking operation based on the rapid cook time.

6. The cooking appliance according to claim 5, further comprising: means for displaying the rapid cook time.

7. The cooking appliance according to claim 1, wherein said controlling means performs the desired cooking operation based on the cooking time, while signaling to a user when the rapid cook time expires.

8. The cooking appliance according to claim 7, wherein the control panel includes a display through which a user is signaled.

9. A cooking appliance comprising:

an oven cavity;

at least one radiant heating element arranged for producing radiant heat in the oven cavity;

a fan for developing a convection air flow within the oven cavity;

a convection heating element for heating the air flow;

a control panel for both selecting a desired cooking operation for the oven cavity and inputting a cooking time for the desired cooking operation;

means for calculating a rapid cook time based on the cooking time, with said rapid cook time being set equal to the cooking time if the cooking time is less than a predetermined amount and automatically set equal to a reduced percentage of the cooking time if the cooking time is greater than the predetermined amount; and means for controlling the at least one radiant heating element, the fan and the convection heating element to perform the desired cooking operation.

10. The cooking appliance according to claim 9, wherein said calculating means reduces the cooking time by 25% to set the rapid cook time.

11. The cooking appliance according to claim 10, wherein the predetermined amount is equal to or greater than one hour.

12. The cooking appliance according to claim 9, wherein said controlling means performs the desired cooking operation based on the rapid cook time.

13. The cooking appliance according to claim 12, further comprising: means for displaying the rapid cook time.

14. The cooking appliance according to claim 9, wherein said controlling means performs the desired cooking operation based on the cooking time, while signaling to a user when the rapid cook time expires.

15. The cooking appliance according to claim 14, wherein the control panel includes a display through which a user is signaled.

16. In a cooking appliance including an oven cavity adapted to be heated by both a radiant heating source and a rapid cook heating source, a method of establishing parameters of a cooking operation comprising:

inputting a desired cooking operation;

inputting a cooking time;

determining if the cooking time is greater than a predetermined amount;

calculating a rapid cook time, which includes automatically reducing the cooking time, only if the cooking time is determined to be greater than the predetermined amount; and performing the desired cooking operation.

17. The method of claim 16, wherein the cooking time is automatically reduced by 25% to establish the rapid cook time.

18. The method of claim 16, further comprising: performing the desired cooking operation for the rapid cook time.

19. The method of claim 16, further comprising:

allowing the desired cooking operation to be performed for the cooking time; and signaling a user when the rapid cook time has expired.

20. The method of claim 16, wherein the desired cooking operation is performed by operating at least one electric heat element, a convection fan and a convection heating element.

* * * * *